US012728500B2

(12) United States Patent
Yun et al.

(10) Patent No.: US 12,728,500 B2
(45) Date of Patent: Sep. 8, 2026

(54) CONDITIONING DEVICE AND METHOD FOR CONTROLLING THE CONDITIONING DEVICE

(71) Applicant: ENPULSE CO., LTD., Chungcheongnam-Do (KR)

(72) Inventors: Jong Wook Yun, Gyeonggi-do (KR); Jang Won Seo, Gyeonggi-do (KR); Su Young Moon, Gyeonggi-do (KR); Kyung Hwan Kim, Gyeonggi-do (KR); Tae Kyoung Kwon, Gyeonggi-do (KR)

(73) Assignee: ENPULSE CO., LTD., Chungcheongnam-do (KR)

( * ) Notice: Subject to any disclaimer, the term of this patent is extended or adjusted under 35 U.S.C. 154(b) by 541 days.

(21) Appl. No.: 18/302,786

(22) Filed: Apr. 19, 2023

(65) Prior Publication Data

US 2023/0339072 A1 Oct. 26, 2023

(30) Foreign Application Priority Data

Apr. 20, 2022 (KR) ..... 10-2022-0049069

(51) Int. Cl.
*B24B 53/017* (2012.01)

(52) U.S. Cl.
CPC ..... *B24B 53/017* (2013.01)

(58) Field of Classification Search
USPC ..... 451/7, 53, 56, 72, 443
See application file for complete search history.

(56) References Cited

U.S. PATENT DOCUMENTS

| | | | | |
|---|---|---|---|---|
| 11,697,187 | B2 * | 7/2023 | Wu | B24B 37/015 451/56 |
| 2013/0023186 | A1 * | 1/2013 | Motoshima | B24B 49/14 451/36 |
| 2020/0262024 | A1 * | 8/2020 | Chang | B24B 37/015 |
| 2021/0402555 | A1 * | 12/2021 | Kumar | B24B 37/015 |

FOREIGN PATENT DOCUMENTS

| | | | |
|---|---|---|---|
| CN | 102179757 | A | 9/2011 |
| CN | 102528651 | A | 7/2012 |
| JP | 2007035973 | A | 2/2007 |
| JP | 2013059831 | A | 4/2013 |
| JP | 2014183221 | A | 9/2014 |
| JP | 2017037985 | A | 2/2017 |

(Continued)

OTHER PUBLICATIONS

Machine translation of CN 113070812 to Lu et al. (Year: 2021).*

(Continued)

*Primary Examiner* — Monica S Carter
*Assistant Examiner* — Jonathan R Zaworski
(74) *Attorney, Agent, or Firm* — IP & T GROUP LLP

(57) ABSTRACT

A conditioning device includes: an ejector for ejecting steam to a rotating polishing pad; and an ejector support supporting the ejector. The ejector includes a plurality of nozzles for ejecting the steam to the polishing pad and a nozzle heater for heating the plurality of nozzles. The nozzle heater is configured to heat nozzles disposed to correspond to a peripheral region of the polishing pad, among the plurality of nozzles, to a higher temperature than nozzles disposed to correspond to a central region of the polishing pad among the plurality of nozzles.

13 Claims, 6 Drawing Sheets

(56) References Cited

FOREIGN PATENT DOCUMENTS

| | | | |
|---|---|---|---|
| KR | 10-1722555 | B1 | 4/2017 |
| KR | 10-2021-0113041 | A | 9/2021 |
| KR | 10-2021-0141786 | A | 11/2021 |

OTHER PUBLICATIONS

Machine translation of CN 113103151 to Lu et al. (Year: 2021).*
Machine translation of CN 113442058 to Liu et al. (Year: 2021).*
Machine translation of CN 113442068 to Zhao et al. (Year: 2021).*
Office Action for the Japanese Patent Application No. 2023-068905 issued by the Japanese Patent Office on Mar. 12, 2024.
Office Action for Korean Patent Application No. 10-2022-0049069 issued by the Korean Patent Office on Apr. 1, 2024.
Office Action for Chinese Patent Application No. 202310430784.0 issued by the Chinese Patent Office on Jul. 24, 2025.

* cited by examiner

CONDITIONING DEVICE AND METHOD FOR CONTROLLING THE CONDITIONING DEVICE

CROSS-REFERENCE TO RELATED APPLICATIONS

The present application claims priority of Korean Patent Application No. 10-2022-0049069, filed on Apr. 20, 2022, which is incorporated herein by reference in its entirety.

TECHNICAL FIELD

The present disclosure relates to a conditioning device and a method for controlling the conditioning device.

BACKGROUND

Recently, the importance of a chemical mechanical polishing (CMP) process is increasing as the size of individual chips of semiconductor devices has been miniaturized, the degree of integration of chips has increased, and circuit patterns formed on chips have been refined.

In the CMP process, a polishing slurry is supplied to a rotating polishing pad, and the supplied polishing slurry is uniformly distributed on the surface of the polishing pad by rotation of the polishing pad. As a surface of the rotating polishing pad on which the polishing slurry is distributed and a surface of a rotating object (substrate, semiconductor device, circuit pattern, etc.) to be polished come into contact with each other, the surface of the object is polished. The surface of the object is chemically polished through the polishing slurry. In addition, the surface of the rotating object is mechanically polished through physical contact with the surface of the rotating polishing pad.

Such a CMP process is a process of flattening a surface of an object to be polished or removing aggregated substances on the surface of the object, scratches and contaminants formed on the surface of the object. In the CMP process, a polishing pad for polishing a surface of an object to be polished is used. The polishing pad used in the CMP process is a process component for processing the surface of the object to be polished to a desired level through friction, and is a factor that determines the uniformity, flatness, quality, etc. of the thickness of the polished object surface.

When the CMP process is repeatedly performed, the polishing performance of the polishing pad is deteriorated due to wear. The polishing pad with reduced polishing performance needs to be replaced with a new polishing pad, and the former is discarded. As such, as the polishing pad with reduced polishing performance is discarded without being reused, the replacement cost of the polishing pad periodically occurs, and environmental pollution due to the discarded polishing pad intensifies.

Accordingly, there is an increasing need for a conditioning device capable of restoring a polishing pad with reduced polishing performance to be reused and minimizing a waste amount of the polishing pad due to the reuse of the polishing pad.

SUMMARY

In view of the above, one embodiment of the present disclosure provides a conditioning device capable of restoring a polishing pad with reduced polishing performance to be reused.

In addition, one embodiment of the present disclosure provides a conditioning device capable of increasing a lifespan of a polishing pad to minimize the waste amount of the polishing pad.

In accordance with a first aspect of the present disclosure, there is provided a conditioning device including: an ejector for ejecting steam to a rotating polishing pad; and an ejector support supporting the ejector, wherein the ejector includes a plurality of nozzles for ejecting the steam to the polishing pad and a nozzle heater for heating the plurality of nozzles, and wherein the nozzle heater is configured to heat nozzles disposed to correspond to a peripheral region of the polishing pad, among the plurality of nozzles, to a higher temperature than nozzles disposed to correspond to a central region of the polishing pad among the plurality of nozzles.

The conditioning device may further include: a sensor for measuring a temperature of the polishing pad; and a controller for controlling the ejector based on a measurement result of the sensor, wherein the peripheral region is disposed outside the central region in a radial direction of the polishing pad to surround the central region, and wherein the conditioning device calculates a difference value between a central temperature, which is a temperature of the central region, and a peripheral temperature, which is a temperature of the peripheral region, and when the difference value is greater than a predetermined set value, controls the nozzle heater so that the nozzles disposed to correspond to the peripheral region among the plurality of nozzles are heated to a higher temperature than the nozzles disposed to correspond to the central region among the plurality of nozzles.

The peripheral region may include: an inner peripheral region surrounding the central region; and an outer peripheral region disposed outside the inner peripheral region in the radial direction to surround the inner peripheral region, wherein the controller calculates a first difference value that is a difference value between the central temperature and a first peripheral temperature which is a temperature of the inner peripheral region, and a second difference value that is a difference value between the central temperature and a second peripheral temperature which is a temperature of the outer peripheral region, and when the first difference value is smaller than the set value and the second difference value is greater than the set value, controls the nozzle heater so that the nozzles disposed to correspond to the inner peripheral area among the plurality of nozzles are heated to a higher temperature than the nozzles disposed to correspond to the outer peripheral region among the plurality of nozzles.

When the difference value is greater than the set value, the controller may determine a heating time corresponding to the difference value and during the determined heating time, control the nozzle heater so that the nozzles disposed to correspond to the peripheral area among the plurality of nozzles are heated to a higher temperature than the nozzles disposed to correspond to the central region among the plurality of nozzles.

The plurality of nozzles may be arranged spaced apart in a radial direction of the polishing pad, a steam room for accommodating the steam may be formed in the ejector, and the steam room may extend in the radial direction and communicates with the plurality of nozzles.

The conditioning device may further include a room heater for heating the steam room to prevent condensation of the steam accommodated in the steam room.

The steam room may be disposed above the plurality of nozzles.

The conditioning device may further include a driver including a vertical driver for moving the ejector support in an up-down direction to adjust a vertical separation distance between the polishing pad and the ejector.

The conditioning device may further include a controller for controlling the driver, the controller may calculate an angle of ejection pattern of the steam based on an eject pressure of the steam ejected from the plurality of nozzles, determine a target separation distance based on the calculated angle of ejection pattern, and controls the vertical driver so that a vertical separation distance between the plurality of nozzles and an upper surface of the polishing pad becomes the target separation distance.

The ejector may extend in a radial direction of the polishing pad, and the driver may further include a linear driver for moving the ejector in the radial direction with respect to the polishing pad.

In accordance with a second aspect of the present disclosure, there is provided a method for controlling a conditioning device including: ejecting steam to a rotating polishing pad through a plurality of nozzles; and heating a plurality of nozzles so that nozzles disposed to correspond to a peripheral region of the polishing pad among the plurality of nozzles, are heated to a higher temperature than nozzles disposed to correspond to a central region of the polishing pad among the plurality of nozzles.

The method may further include: measuring a temperature of the polishing pad; and calculating a difference value between a central temperature which is a temperature of the central region, and a peripheral temperature which is a temperature of the peripheral region, wherein in the heating of the plurality of nozzles, when the difference value is greater than a predetermined set value, the nozzles disposed to correspond to the peripheral region of the polishing pad are heated to a higher temperature than the nozzles disposed to correspond to the central region, and wherein the peripheral region is disposed outside the central region in a radial direction of the polishing pad to surround the central region.

The peripheral region may include an inner peripheral region surrounding the central region, and an outer peripheral region disposed outside the inner peripheral region in the radial direction to surround the inner peripheral region, wherein the measuring of the temperature of the polishing pad may include: measuring the central temperature; measuring a first peripheral temperature which is a temperature of the inner peripheral region; and measuring a second peripheral temperature which is a temperature of the outer peripheral region, wherein the calculating of the difference value may include: calculating a first difference value that is a difference value between the central temperature and the first peripheral temperature; and calculating a second difference value that is a difference value between the central temperature and the second peripheral temperature, and wherein in the heating of the plurality of nozzles includes, when the first difference value is smaller than the set value and the second difference value is greater than the set value, the nozzles disposed to correspond to the inner peripheral area among the plurality of nozzles may be heated to a higher temperature than the nozzles adjacent to the outer peripheral region among the plurality of nozzles.

The method may further include determining a heating time corresponding to the difference value when the difference value is greater than the set value, wherein the heating of the plurality of nozzles is performed during the determined heating time.

With the conditioning device according to one embodiment of the present disclosure, the polishing pad with reduced polishing performance can be restored to be reused.

In addition, with the conditioning device according to one embodiment of the present disclosure, the lifespan of the polishing pad can be increased to minimize the waste amount of the polishing pad.

DETAILED DESCRIPTION

Figure 1:
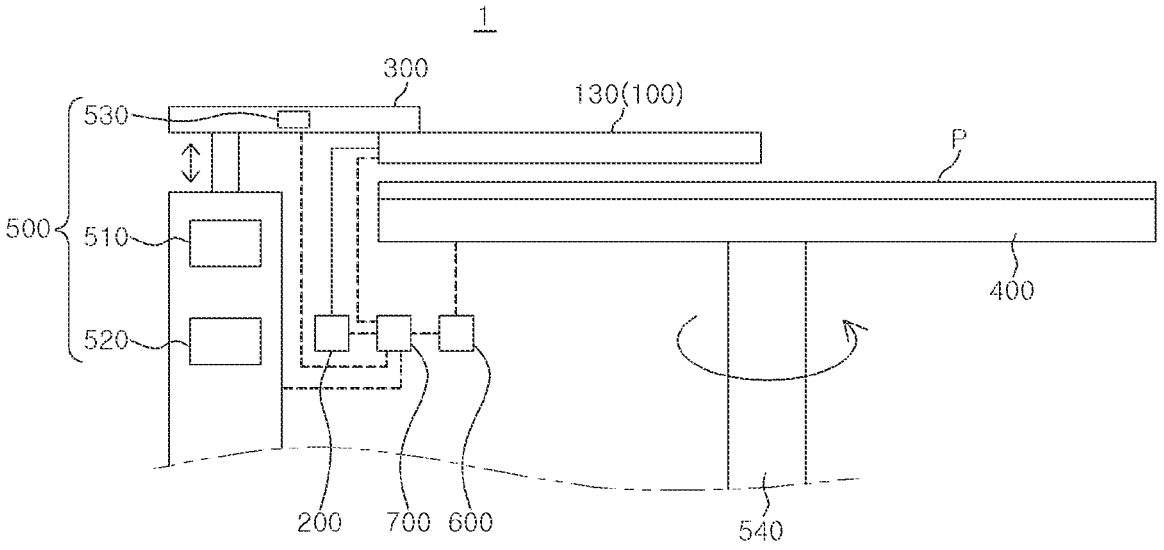
FIG. 1 is a side view of a conditioning device according to one embodiment of the present disclosure.

Hereinafter, specific embodiments for implementing a spirit of the present disclosure will be described in detail with reference to the drawings.

In describing the present disclosure, detailed descriptions of known configurations or functions may be omitted to clarify the present disclosure.

When an element is referred to as being 'connected' to, 'seated' on, or 'supported' by another element, it should be understood that the element may be directly connected to, seated on, or supported by another element, but that other elements may exist in the middle.

The terms used in the present disclosure are only used for describing specific embodiments, and are not intended to limit the present disclosure. Singular expressions include plural expressions unless the context clearly indicates otherwise.

Terms including ordinal numbers, such as first and second, may be used for describing various elements, but the corresponding elements are not limited by these terms. These terms are only used for the purpose of distinguishing one element from another element.

In the present specification, it is to be understood that the terms such as "including" are intended to indicate the existence of the certain features, areas, integers, steps, actions, elements, combinations, and/or groups thereof disclosed in the specification, and are not intended to preclude the possibility that one or more other certain features, areas, integers, steps, actions, elements, combinations, and/or groups thereof may exist or may be added.

In addition, in the present specification, expressions such as upper, lower, and upper surface are described based on the drawings, and it is made clear in advance that they may be differently expressed when the orientation of the object is changed. Further, in the present specification, inward and outward directions may be right and left directions in FIGS. 2 and 3, respectively. In addition, one direction in the present specification may be understood as a direction including a radial direction of the polishing pad. The radial direction is a direction including inward and outward radial directions, and the inward radial direction may be defined as a direction parallel to a horizontal direction and approaching the center of the polishing pad P. Further, the outward radial direction may be defined as the opposite direction of the inward radial direction.

Hereinafter, a specific configuration of a conditioning device 1 according to one embodiment of the present disclosure will be described with reference to the drawings.

A CMP facility may include a substrate carrier, a slurry supply device, and a conditioning device 1. A semiconductor substrate may be mounted on the substrate carrier. The substrate carrier is capable of rotating the mounted substrate. A surface of the substrate mounted on the substrate carrier may be polished while being in contact with an edge portion of a polishing surface of a polishing pad P. For example, the substrate carrier may press the substrate in contact with the polishing surface against the polishing pad P while rotating the substrate. While the substrate is being polished, the slurry supply device may supply a polishing slurry to the polishing surface of the rotating polishing pad P. In this way, the CMP facility may perform a CMP process of mechanically polishing the substrate through the substrate carrier and chemically polishing the substrate through the slurry supply device.

Figure 2:
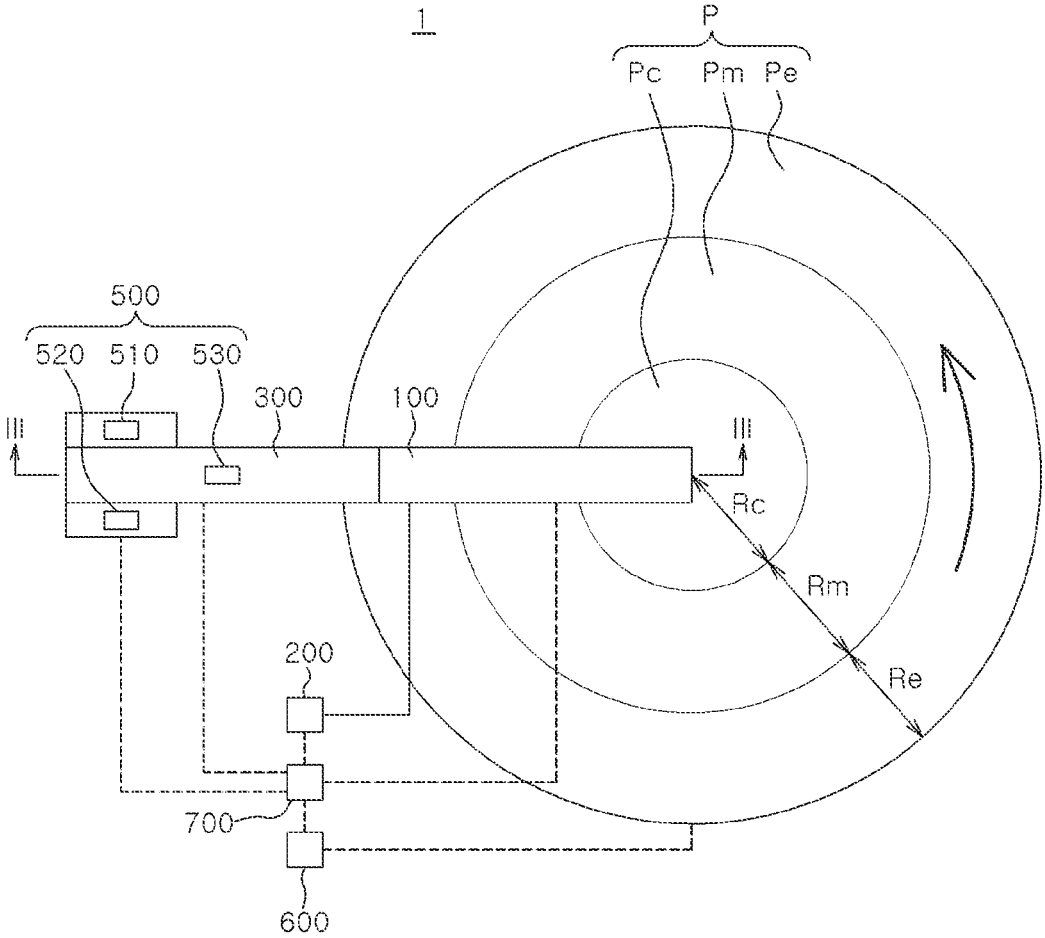
FIG. 2 is a plan view of the conditioning device according to one embodiment of the present disclosure.

Referring to FIGS. 1 and 2, the conditioning device 1 may restore the polishing pad P that has been subjected to the CMP process for a predetermined period of time or longer. A material of the polishing pad P may include polyurethane. Polyurethane included in the polishing pad P may be deformed by stress applied by an object to be polished, and may be restored to its original shape when heated. In other words, the polishing pad P may have self-restoring ability by heat. The polishing pad P may have a cylindrical shape with predetermined radii Rc, Rm, and Re. The conditioning device 1 can eject steam to an upper surface of the polishing pad P. The conditioning device 1 may include an ejector 100, a steam supply unit 200, an ejector support 300, a pad support 400, a driver 500, a sensor 600, and a controller 700.

Figure 3:
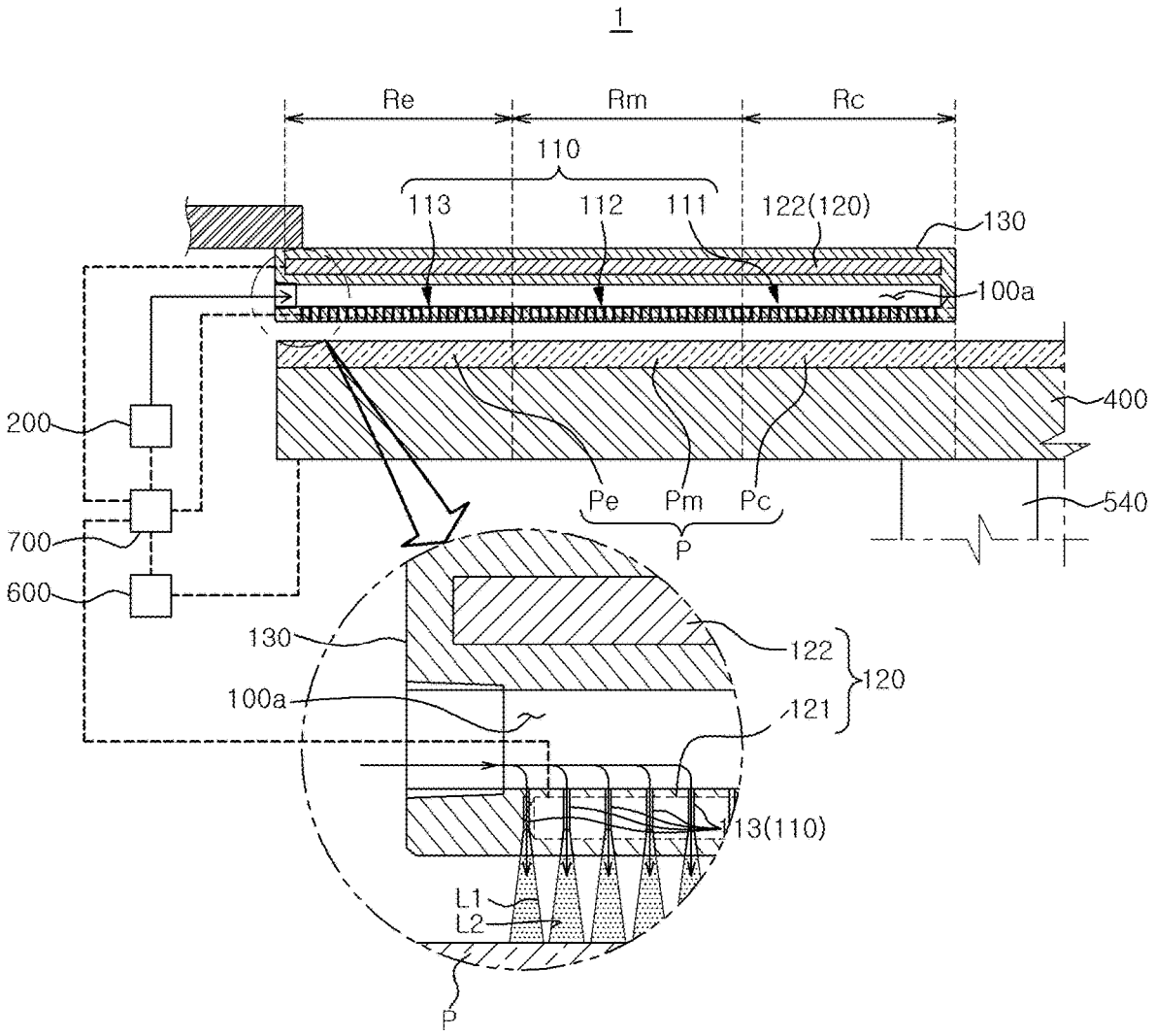
FIG. 3 is a longitudinal cross-sectional view taken along line of FIG. 2.

Referring further to FIG. 3, the ejector 100 may receive steam from the steam supply unit 200 and eject the supplied steam onto the upper surface of the polishing pad P. A lower end of the ejector 100 may face the upper surface of the polishing pad P seated on the pad support 400. The ejector 100 may extend along a radial direction.

An inner end of the ejector 100 may be disposed to face the center of the pad support 400. Further, an outer end of the ejector 100 may be connected to the ejector support 300. The outer end of the ejector 100 may mean an end opposite to the inner end of the ejector 100. A steam room 100*a* may be formed in the ejector 100. In addition, the ejector 100 may include a nozzle 110, a heater 120, and a frame 130.

The steam room 100*a* may receive steam supplied from the steam supply unit 200. The steam room 100*a* may extend along the radial direction. The steam room 100*a* may be a long hole having a closed inner end in the horizontal direction. For example, the inner end of the steam room 100*a* may be closed and an outer end thereof may be open to provide a steam inlet through which steam supplied from the steam supply unit 200 may be introduced.

The steam room 100*a* may communicate with a plurality of nozzles to be described later. In addition, the steam room 100*a* may be disposed above the plurality of nozzles. For example, steam received in the steam room 100*a* may flow toward the plurality of nozzles. Variation in the pressure of steam supplied to each of the plurality of nozzles can be minimized through the steam room 100*a*. In other words, the steam supplied from the steam supply unit 200 is filled in the steam room 100*a* until the pressure in the steam room 100*a* is in equilibrium with atmospheric pressure, and after the pressure of the steam and the atmospheric pressure are in equilibrium, the steam may be ejected onto the polishing pad P through the plurality of nozzles.

The nozzle 110 may eject the steam received in the steam room 100*a* to the polishing pad P. The temperature of the steam ejected from the nozzle 110 may be, for example, 55° C. to 70° C. A lower portion of the nozzle 110 may have a tapered shape in which a width thereof is widened toward a lower side. The nozzle 100 may include a plurality of nozzles 110.

The plurality of nozzles 110 may be spaced apart along the radial direction. The plurality of nozzles 110 may communicate with the steam room 100*a*. In addition, the plurality of nozzles 110 may be disposed below the steam room 100*a*. The plurality of nozzles 110 may include a center nozzle part 111, a middle nozzle part 112, and an edge nozzle part 113.

The center nozzle part 111 may be disposed to correspond to a central region Pc of the polishing pad. For example, the center nozzle part 111 may be disposed to face the upper surface of the central region Pc. The center nozzle part 111 may eject steam to the upper surface of the central region Pc of the polishing pad seated on the pad supporter 400. The central region Pc may be referred to as a 'pad center part'. For example, the central region Pc may have a cylindrical shape having a radius of ⅓ of the radius (Rc+Rm+Re) of the polishing pad P. The central region Pc may be disposed to be surrounded by peripheral regions Pm and Pe of the polishing pad. The peripheral regions Pm and Pe may be disposed outside the central region Pc in the radial direction. The peripheral regions Pm and Pe may include an inner peripheral region Pm and an outer peripheral region Pe. Further, the center nozzle part 111 may be disposed further inside than the middle nozzle part 112.

The middle nozzle part 112 may be disposed to correspond to the inner peripheral region Pm. For example, the middle nozzle part 112 may be disposed to face the upper surface of the inner peripheral region Pm. The middle nozzle part 112 may eject steam to the upper surface of the inner peripheral region Pm of the polishing pad P seated on the pad support 400. The inner peripheral region Pm may be referred to as a 'pad middle part'. The inner peripheral region Pm may have a hollow cylindrical shape. For example, the radius of an inner circumferential surface of the inner peripheral region Pm may be the radius of an outer circumferential surface of the central region Pc. The inner peripheral region Pm may be disposed to surround the central region Pc. For example, the inner peripheral region Pm may be disposed outside the central region Pc in the radial direction.

In addition, an outer circumferential surface of the inner peripheral region Pm may have an annular ring shape whose radius is a radius of an inner circumferential surface of the outer peripheral region Pe of the polishing pad P, which will be described later. In the radial direction of the polishing pad P, the distance between the inner circumferential surface and the outer circumferential surface of the inner peripheral region Pm may be, for example, ⅓ of the radius (Rc+Rm+Re) of the polishing pad P. In addition, the inner peripheral region Pm may be disposed between the central region Pc and the outer peripheral region Pe of the polishing pad P. Further, the middle nozzle part 112 may be disposed between the center nozzle part 111 and the edge nozzle part 113. For example, the middle nozzle part 112 may be disposed further inside than the edge nozzle part 113.

The edge nozzle part 113 may be disposed to correspond to the outer peripheral region Pe. For example, the edge nozzle part 113 may be disposed to face the upper surface of the outer peripheral region Pe. The edge nozzle part 113 may eject steam onto the upper surface of the outer peripheral region Pe of the polishing pad P seated on the pad supporter 400. The outer peripheral region Pe of the polishing pad P may be referred to as a 'pad edge part'. The edge nozzle part 113 may include a plurality of nozzles. The outer peripheral region Pe may have a hollow cylindrical shape. For example, the radius of the inner circumferential surface of the outer peripheral region Pe may be the radius of the outer circumferential surface of the inner peripheral region Pm. In addition, a radius of the outer circumferential surface of the outer peripheral region Pe may be the radius of the polishing pad P. In the radial direction of the polishing pad P, the distance between the inner and outer circumferential surfaces of the outer peripheral region Pe may be, for example, ⅓ of the radius (Rc+Rm+Re) of the polishing pad P.

The heater 120 may include a nozzle heater 121 and a room heater 122. The nozzle heater 121 may heat some or all of the plurality of nozzles 110. For example, the nozzle heater 121 may increase the temperature of steam passing through the plurality of nozzles 110. The nozzle heater 121 may independently heat each of the plurality of nozzles 110. In other words, the nozzle heater 121 may be controlled by the controller 700 so that the plurality of nozzles 110 eject steam at different temperatures, respectively. For example, a plurality of nozzle heaters 121 may be provided to be independently controlled by the controller 700. However, this is only an example, and one nozzle heater 121 may be provided to independently heat the plurality of nozzles 110. The nozzle heater 121 may be controlled by the controller 700.

The room heater 122 may heat steam accommodated in the steam room 100*a*. Through the room heater 122, condensation of the steam accommodated in the steam room 100*a* may be prevented. The room heater 122 may be disposed above the steam room 100*a*. As the room heater 122 is disposed above the steam room 100*a*, it is possible to prevent the plurality of nozzles from being heated by the room heater 122. The frame 130 may support the nozzle 110 and the heater 120. The frame 130 may form the appearance of the ejector 100.

The steam supply part 200 may supply steam to the steam room 100*a*. The steam supplied by the steam supply unit 200 to the steam room 100*a* may be, for example, water vapor. The temperature of the steam supplied by the steam supply unit 200 to the steam room 100*a* may be, for example, 70° C. to 110° C.

The ejector support 300 may support the ejector 100. The polishing pad P may be seated on an upper surface of the pad support 400, and the seated polishing pad P may be supported thereon. The pad support 400 may fix the position of the seated polishing pad P so that the polishing pad P is placed in a predetermined position. For example, the position of the center of the polishing pad P seated on the pad support 400 may be fixed. The pad support 400 may be rotated about a pad rotation axis extending in the up-down direction together with the polishing pad P in a state in which the polishing pad P is supported on the pad support 400. For example, the ejector 100 may eject steam onto the upper surface of the polishing pad P while being rotated by the pad support 400.

Meanwhile, the idea of the present disclosure is not necessarily limited to the above, and the pad support 400 may be a separate component from the conditioning device 1. In other words, the pad support 400 may be included in the CMP device, but may not be included in the conditioning device 1.

The driver 500 may be controlled by the controller 700. The driver 500 may include a vertical driver 510, a linear driver 520, a rotary driver 530, and a pad driver 540. The vertical driver 510 may adjust a vertical separation distance between the polishing pad P seated at the predetermined position and the ejector 100. The vertical driver 510 may move the ejector support 300 in the up-down direction with respect to the pad support 400. The vertical driver 510 may be, for example, an actuator.

Figure 4:
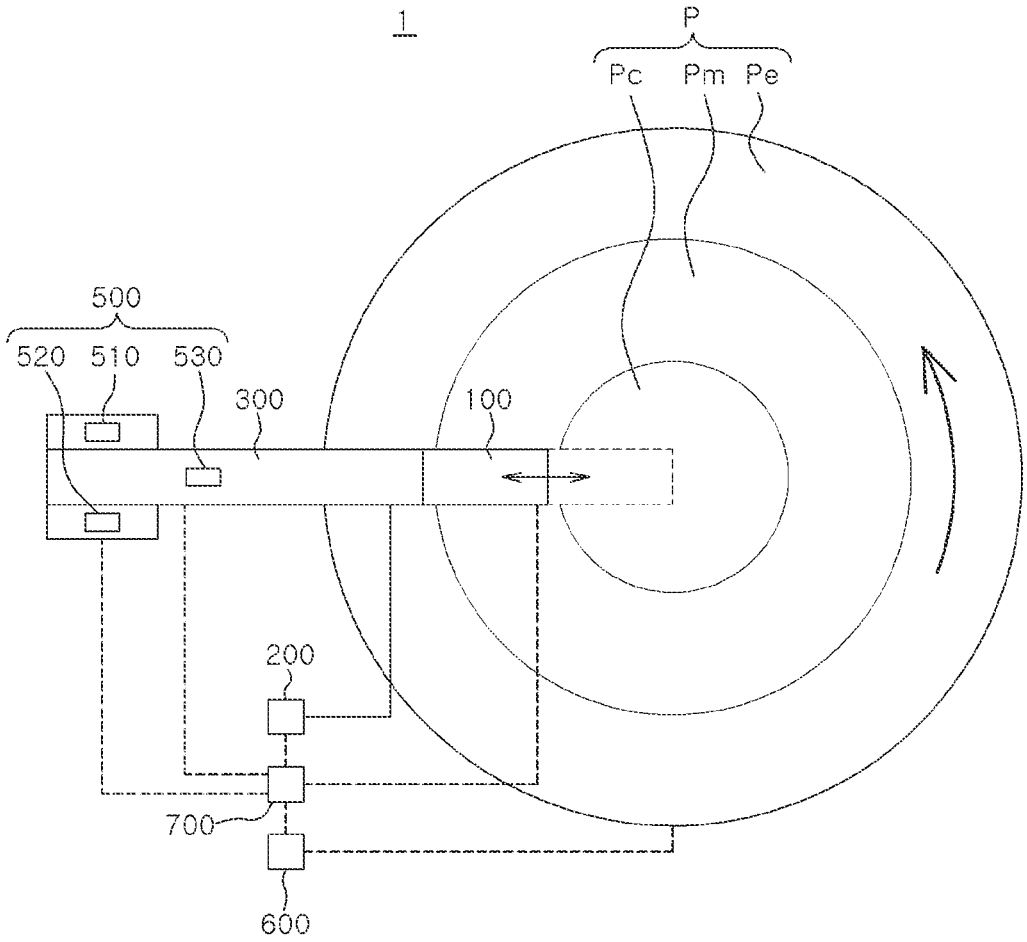
FIG. 4 is a plan view illustrating a state in which an ejector according to one embodiment of the present disclosure is moved along a radial direction of a polishing pad.

Referring further to FIG. 4, the linear driver 520 may move the ejector 100 relative to the ejector support 300 in the radial direction. In other words, the linear driver 520 may linearly move the ejector 100 relative to the ejector support 300. In addition, although not shown in the drawings, a guide protrusion may be formed on one of the ejector 100 and the ejector support 300, and a guide groove engaged with the guide protrusion may be formed on the other one. As a more specific example, a guide protrusion which protrudes upward may be formed at an upper end of the ejector 100, and a guide groove which is depressed upward and extends in the radial direction may be formed at a lower end of the ejector support 300. The guide protrusion of the ejector 100 may be moved in the radial direction along the guide groove 320 while being engaged with the guide groove of the ejector support 300. The linear driver 520 may be, for example, an actuator.

Figure 5:
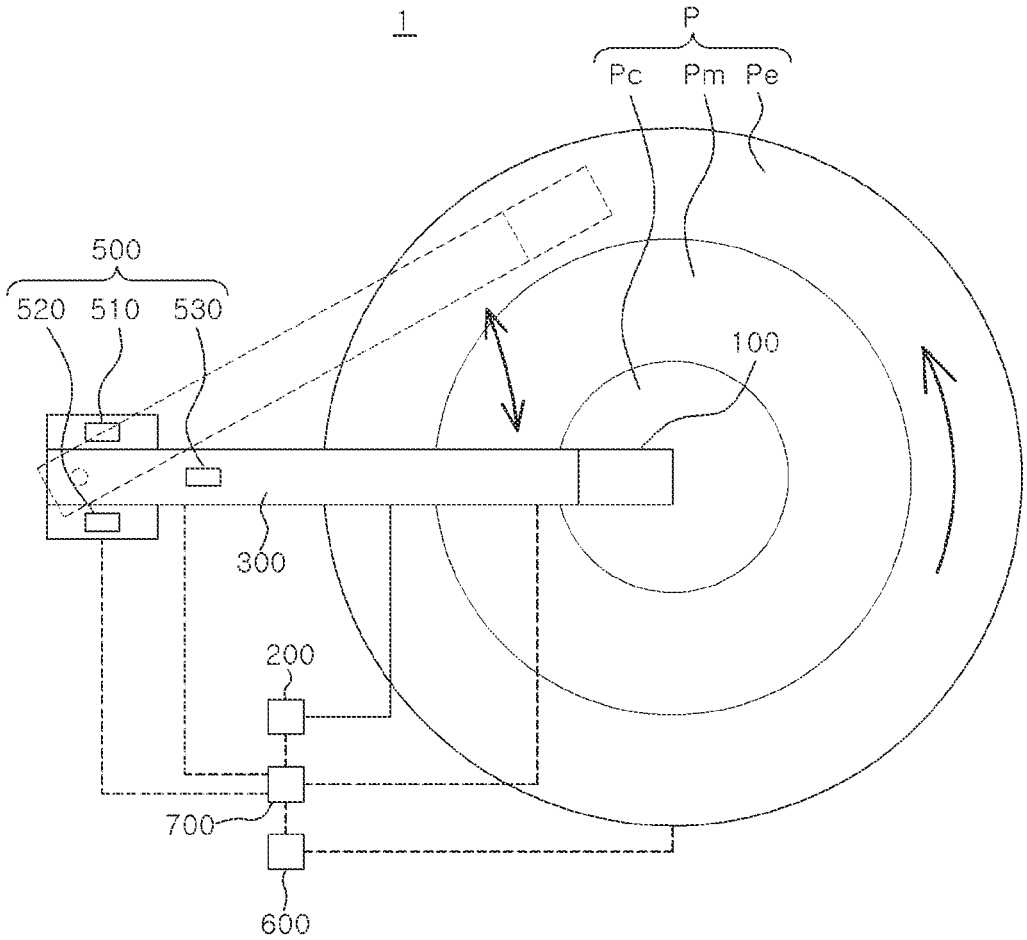
FIG. 5 is a plan view showing a rotated state of an ejector support according to one embodiment of the present disclosure.

Referring further to FIG. 5, the rotary driver 530 may rotate the ejector support 300 about an ejector rotation axis extending in the up-down direction. For example, when the rotary driver 530 rotates the ejector support 300, the inner end of the ejector 100 can be reciprocatingly moved between the outer and inner sides of the polishing pad P while facing the upper surface of the polishing pad P. The rotary driver 530 may include, for example, a motor and a shaft rotated by the motor.

The pad driver 540 may rotate the pad support 400 about the pad rotation axis extending in the up-down direction. The pad rotation axis may be spaced apart from the ejector rotation axis. For example, when the polishing pad P is seated on the pad support 400, the pad driver 540 rotates the pad support 400 so that the polishing pad P is rotated together with the pad support 400. The pad driver 540 may include, for example, a motor and a shaft rotated by the motor.

The sensor 600 may measure a temperature of the polishing pad P. The sensor 600 may include a plurality of sensors 600. The plurality of sensors 600 may measure the respective temperatures of the central region Pc, the inner peripheral region Pm, and the outer peripheral region Pe. The temperatures of the central region Pc, the inner peripheral region Pm, and the outer peripheral region Pe may be referred to as a central temperature, a first peripheral temperature, and a second peripheral temperature, respectively. Further, the plurality of sensors 600 may be disposed in the ejector 100, for example. For example, some of the plurality of sensors 600 may be disposed in the center nozzle part 111, another part in the middle nozzle part 112, and the other part in the edge nozzle part 113.

The controller 700 may control the ejector 100 based on the measurement result of the sensor 600. The controller 700 may calculate a difference between the central temperature, which is the temperature of the central region Pc, and the peripheral temperatures, which are the temperatures of the peripheral regions Pm and Pe of the polishing pad. The central temperature and the peripheral temperatures may be an average temperature of the central region Pc and average temperatures of the peripheral regions Pm and Pe of the polishing pad, respectively. The average temperature may be defined as a value obtained by dividing the sum of temperatures of a plurality of unit areas of the upper surface of the polishing pad P by the number of the plurality of unit areas.

For example, the controller 700 may calculate a first difference value which is a difference between the temperatures of the central region Pc and the inner peripheral region Pm, and a second difference value which is a difference value between the temperatures of the central region Pc and the outer peripheral region Pe. The controller 700 may compare a predetermined set value with the first difference value and the second difference value. For example, when the first difference value is greater than the set value, the controller 700 may control the nozzle heater 121 to heat the middle nozzle part 112 and the edge nozzle part 113 to a higher temperature than the center nozzle part 111.

In addition, when the first difference value is smaller than the set value and the second difference value is larger than the set value, the controller 700 may control the nozzle heater 121 to heat the edge nozzle part 113 to a higher temperature than the center nozzle part 111 and the middle nozzle part 112.

The controller 700 may determine a heating time corresponding to the difference value when the difference value is greater than the set value. For example, when the difference value is greater than the set value, the heating time determined by the controller 700 may become longer as the difference value increases.

Referring back to FIG. 3, the controller 700 may calculate an angle of ejection pattern of steam based on ejection pressures of steam ejected from the plurality of nozzles 110. The angle of ejection pattern may be defined as an angle at which an ejection pattern formed by a group of steam particles ejected from the nozzle 110 widens. For example, the angle of ejection pattern may be defined as an angle between a virtual straight line passing through the center of the nozzle 110 and a straight line passing through an outer peripheral surface of the ejection pattern. The angle of ejection pattern may increase as the ejection pressure of the steam ejected from the nozzle 110 increases.

The controller 700 may determine a target separation distance based on the calculated angle of ejection pattern. The target separation distance may be defined as a separation distance between the nozzle 110 and the upper surface of the polishing pad P when the intersection point of a first straight line L1 and a second straight line L2 is disposed below the upper surface of the polishing pad P at the predetermined position. The first straight line L1 may be defined as an imaginary straight line passing through the inward outer peripheral surface of the ejection pattern formed by the steam ejected from a first nozzle. The second straight line L2 may be defined as an imaginary straight line passing through the outward outer peripheral surface of the ejection pattern formed by the steam ejected from a second nozzle.

The first nozzle and the second nozzle may mean any two nozzles adjacent to each other among the plurality of nozzles 110. The first nozzle may be disposed radially outward than the second nozzle. In addition, the first straight line L1 may be defined as an imaginary straight line passing through an inner slope of the first nozzle in a longitudinal cross-sectional view of the ejector 100 cut along the up-down direction (see FIG. 3). In addition, the second straight line L2 may be defined as an imaginary straight line passing through an outer slope of the second nozzle in the longitudinal cross-sectional view of the ejector 100 cut along the up-down direction (see FIG. 3).

The controller 700 may control the vertical driver 510 based on the determined target separation distance. For example, the controller 700 may control the vertical driver 510 so that the distance between the plurality of nozzles 110 and the upper surface of the polishing pad P becomes the target separation distance.

As such, since the controller 700 controls the vertical driver 510 so that the intersection point of the first straight line L1 and the second straight line L2 is located below the upper surface of the polishing pad P, it is possible to prevent steam ejected from two adjacent nozzles among the plurality of nozzles from colliding with each other and being condensed.

The controller 700 may be implemented by an arithmetic device including a microprocessor, and since the implementation method is obvious to those skilled in the art, further detailed description thereof will be omitted.

Hereinafter, operations and effects of the conditioning device 1 according to one embodiment of the present disclosure will be described.

The polishing pad P seated on the pad support 400 of the conditioning device 1 may be placed at the predetermined position. The polishing pad P may be rotated about the pad rotation axis by the pad driver 540 while the center of the polishing pad P is fixed. While the polishing pad P is rotated, the ejector 100 disposed above the polishing pad P may eject steam onto the upper surface of the polishing pad P.

The steam supplied from the steam supply unit 200 may be accommodated in the steam room 100*a* of the ejector 100. The steam may be filled in the steam room 100*a* until the pressure in the steam room 100*a* is in equilibrium with the atmospheric pressure. Since the steam introduced into the steam room 100*a* has a property of flowing upward, the steam can be prevented from flowing to the plurality of nozzles disposed below the steam room 100*a* until the steam room 100*a* is in an equilibrium state. Then, when the pressure in the steam room 100*a* is greater than the atmospheric pressure, the steam may flow toward the plurality of nozzles. The pressure of steam flowing toward the plurality of nozzles can be uniform. Through the steam room 100*a*, there is an effect that it is not necessary to have a plurality of steam supply units for supplying steam to each of the plurality of nozzles in order to directly supply steam with a uniform pressure to the plurality of nozzles.

As the steam room 100*a* is heated by the room heater 122, condensation of the steam accommodated in the steam room 100*a* can be prevented. In addition, the plurality of nozzles may receive steam from the steam room 100*a* and eject the steam to the polishing pad P. The controller 700 may control the vertical driver 510 so that steam ejected from two adjacent nozzles among the plurality of nozzles does not contact each other. As described above, since the steam ejected from two adjacent nozzles among the plurality of nozzles does not come into contact with each other, condensation of the steam can be prevented while the steam is ejected from the nozzles.

In addition, while the polishing pad P is rotated, an area of the polishing pad P exposed to outside air (e.g., air in a workroom) per unit time may increase toward the outer side in the radial direction. Accordingly, while the polishing pad P is rotated, a cooled area of the polishing pad P may increase toward the outer side in the radial direction. For example, if the process of ejecting steam to the rotating polishing pad P continues for a predetermined time, average temperatures of the central region Pc, the inner peripheral region Pm, and the outer peripheral region Pe may be sequentially lowered.

The controller 700 of the conditioning device 1 can control the nozzle heater 121 so that at least one of the heated temperatures of the central nozzle part 111, the middle nozzle part 112, and the edge nozzle part 113 is different from the others to reduce the deviation in the average temperature between the different regions of the polishing pad P.

The conditioning device 1 compares the average temperatures of the different regions of the polishing pad P, and adjusts the temperature at which at least one of the center nozzle part 111, the middle nozzle part 112 and the edge nozzle part 113 is heated, so that the deviation of the average temperature of the polishing pad P can be reduced.

Figure 6:
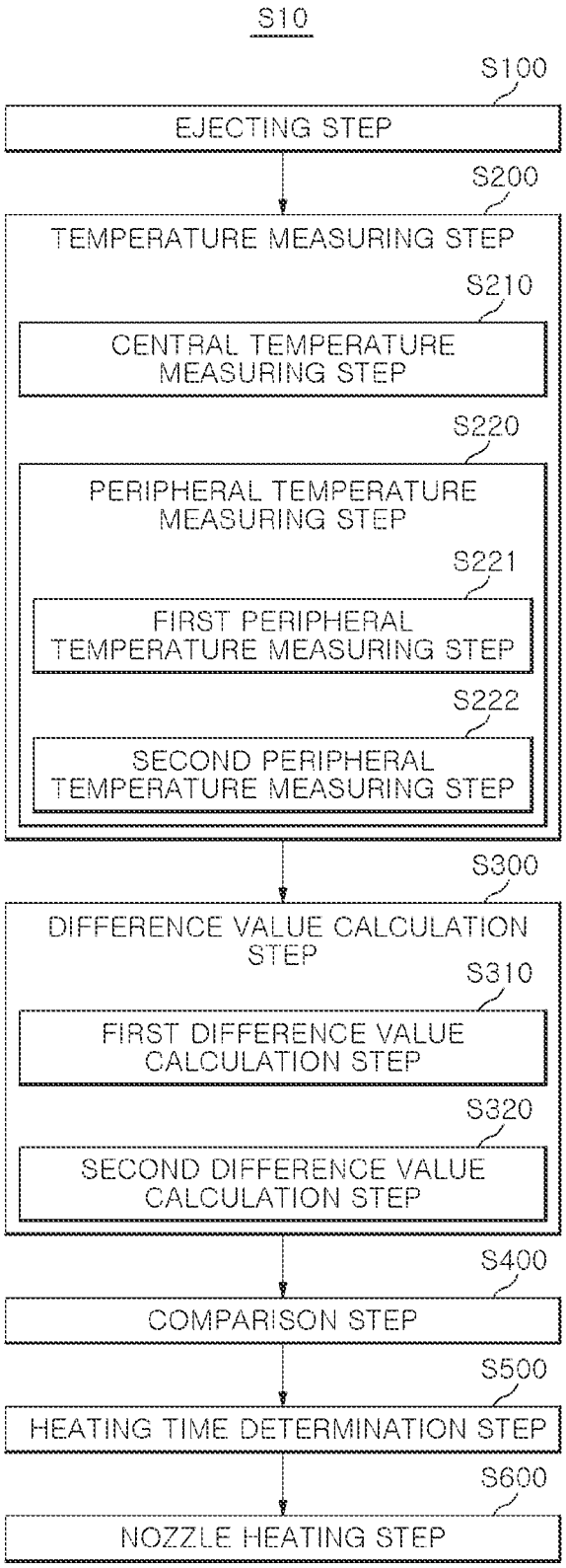
FIG. 6 is a flowchart schematically illustrating a method of controlling the conditioning apparatus according to one embodiment of the present disclosure.

Hereinafter, referring to FIG. 6, a method S10 of controlling the conditioning apparatus according to one embodiment of the present disclosure will be described. In describing the method S10 for controlling the conditioning device, the same description and reference numerals as those of the controller 700 are referred to the above-described contents.

The method S10 for controlling the conditioning device includes an ejecting step S100, a temperature measuring step S200, a difference value calculation step S300, a comparison step S400, a heating time determination step S500, and a nozzle heating step S600.

In the ejecting step S100, steam may be ejected onto the polishing pad P through the plurality of nozzles. The ejecting step S100 may be performed while the polishing pad P is rotated about the pad rotation axis in a state in which it is placed at the predetermined position.

In the temperature measuring step S200, the temperature of the polishing pad P may be measured. The temperature measuring step S200 may include a central temperature measuring step S210 and a peripheral temperature measuring step S220. In the central temperature measuring step S210, the central temperature may be measured. The peripheral temperature measuring step S220 may include a first peripheral temperature measuring step S221 and a second peripheral temperature measuring step S222.

In the first peripheral temperature measuring step S221, a first peripheral temperature of the polishing pad may be measured. Further, in the second peripheral temperature measuring step S222, a second peripheral temperature of the polishing pad may be measured. The central temperature measuring step S210, the first peripheral temperature measuring step S221, and the second peripheral temperature measuring step S222 may be performed simultaneously or at different times.

In the difference value calculation step S300, a difference value between the central temperature and the peripheral temperature may be calculated. The difference value calculation step S300 may include a first difference value calculation step S310 and a second difference value calculation step S320. In the first difference value calculation step S310, a first difference value that is a difference value between the central temperature and the first peripheral temperature may be calculated. In the second difference value calculation step S320, a second difference value that is a difference value between the central temperature and the second peripheral temperature may be calculated.

In the comparison step S400, the set value and the difference value may be compared. For example, in the comparison step S400, a magnitude relationship between the first difference value and the set value may be compared, or a magnitude relationship between the second difference value and the set value may be compared.

In the heating time determination step S500, when the difference value is greater than the set value, a pre-input heating time corresponding to the difference value may be determined. In the nozzle heating step S600, the plurality of nozzles may be heated to different temperatures based on the comparison result in the comparison step S400. In the nozzle heating step S600, when the difference value is greater than the set value, the middle nozzle part 112 and the edge nozzle part 113 may be heated to a higher temperature than the center nozzle part 111. In addition, in the nozzle heating step S600, when the first difference value is smaller than the set value and the second difference value is larger than the set value, the edge nozzle part 113 may be heated to a higher temperature than the middle nozzle part 112. The nozzle heating step S600 may be performed for the heating time determined in the heating time determining step S500.

The examples of the present disclosure have been described above as specific embodiments, but these are only examples, and the present disclosure is not limited thereto, and should be construed as having the widest scope according to the technical spirit disclosed in the present specification. A person skilled in the art may combine/substitute the disclosed embodiments to implement a pattern of a shape that is not disclosed, but it also does not depart from the scope of the present disclosure. In addition, those skilled in the art can easily change or modify the disclosed embodiments based on the present specification, and it is clear that such changes or modifications also belong to the scope of the present disclosure.

What is claimed is:

1. A conditioning device comprising:

an ejector for ejecting steam to a rotating polishing pad;

an ejector support supporting the ejector;

a vertical driver for moving the ejector support in an up-down direction to adjust a vertical separation distance between the polishing pad and the ejector; and a controller for controlling the vertical driver, wherein the ejector includes a plurality of nozzles for ejecting the steam to the polishing pad and a nozzle heater for heating the plurality of nozzles, and wherein the nozzle heater is configured to heat nozzles disposed to correspond to a peripheral region of the polishing pad, among the plurality of nozzles, to a higher temperature than nozzles disposed to correspond to a central region of the polishing pad among the plurality of nozzles, wherein the controller calculates an angle of ejection pattern of the steam based on an eject pressure of the steam ejected from the plurality of nozzles, determines a target separation distance based on the calculated angle of ejection pattern, and controls the vertical driver to make the target separation distance smaller than a straight line distance, the straight line distance being a distance from an intersection point of a first virtual straight line extending along an inclined portion on one side of a first nozzle of the plurality of nozzles and a second virtual straight line extending along an inclined portion on one side of a second nozzle facing with the one side of the first nozzle to the ejector, and wherein the second nozzle is disposed adjacent to the first nozzle.

2. The conditioning device of claim 1, further comprising a sensor for measuring a temperature of the polishing pad, wherein the controller further controls the ejector based on a measurement result of the sensor, wherein the peripheral region is disposed outside the central region in a radial direction of the polishing pad to surround the central region, and wherein the controller calculates a difference value between a central temperature, which is a temperature of the central region, and a peripheral temperature, which is a temperature of the peripheral region, and when the difference value is greater than a predetermined set value, controls the nozzle heater so that the nozzles disposed to correspond to the peripheral region among the plurality of nozzles are heated to a higher temperature than the nozzles disposed to correspond to the central region among the plurality of nozzles.

3. The conditioning device of claim 2, wherein the peripheral region includes:

an inner peripheral region surrounding the central region; and an outer peripheral region disposed outside the inner peripheral region in the radial direction to surround the inner peripheral region, wherein the controller calculates a first difference value that is a difference value between the central temperature and a first peripheral temperature which is a temperature of the inner peripheral region, and a second difference value that is a difference value between the central temperature and a second peripheral temperature which is a temperature of the outer peripheral region, and when the first difference value is smaller than the set value and the second difference value is greater than the set value, controls the nozzle heater so that the nozzles disposed to correspond to the outer peripheral area among the plurality of nozzles are heated to a higher temperature than the nozzles disposed to correspond to the inner peripheral region among the plurality of nozzles.

4. The conditioning device of claim 2, wherein when the difference value is greater than the set value, the controller determines a heating time corresponding to the difference value and during the determined heating time, controls the nozzle heater so that the nozzles disposed to correspond to the peripheral area among the plurality of nozzles are heated to a higher temperature than the nozzles disposed to correspond to the central region among the plurality of nozzles.

5. The conditioning device of claim 1, wherein the plurality of nozzles are arranged spaced apart in a radial direction of the polishing pad, a steam room for accommodating the steam is formed in the ejector, and the steam room extends in the radial direction and communicates with the plurality of nozzles.

6. The conditioning device of claim 5, further comprising a room heater for heating the steam room to prevent condensation of the steam accommodated in the steam room.

7. The conditioning device of claim 5, wherein the steam room is disposed above the plurality of nozzles.

8. The conditioning device of claim 1, wherein the ejector extends in a radial direction of the polishing pad, and the driver further includes a linear driver for moving the ejector in the radial direction with respect to the polishing pad.

9. A conditioning device comprising:

an ejector for ejecting steam to a rotating polishing pad;

an ejector support supporting the ejector;

a driver including a vertical driver for moving the ejector support in an up-down direction to adjust a vertical separation distance between the polishing pad and the ejector; and a controller for controlling the driver, wherein the ejector includes a plurality of nozzles for ejecting the steam to the polishing pad and a nozzle heater for heating the plurality of nozzles, wherein the nozzle heater is configured to heat nozzles disposed to correspond to a peripheral region of the polishing pad, among the plurality of nozzles, to a higher temperature than nozzles disposed to correspond to a central region of the polishing pad among the plurality of nozzles, and wherein the controller calculates an angle of ejection pattern of the steam based on an eject pressure of the steam ejected from the plurality of nozzles, determines a target separation distance based on the calculated angle of ejection pattern, and controls the vertical driver so that a vertical separation distance between the plurality of nozzles and an upper surface of the polishing pad becomes the target separation distance.

10. A method for controlling a conditioning device, comprising:

providing the conditioning device including:

an ejector for ejecting steam to a rotating polishing pad;

an ejector support supporting the ejector;

a vertical driver for moving the ejector support in an up-down direction to adjust a vertical separation distance between the polishing pad and the ejector; and a controller for controlling the vertical driver, wherein the ejector includes a plurality of nozzles for ejecting the steam to the polishing pad and a nozzle heater for heating the plurality of nozzles, and wherein the nozzle heater is configured to heat nozzles disposed to correspond to a peripheral region of the polishing pad, among the plurality of nozzles, to a higher temperature than nozzles disposed to correspond to a central region of the polishing pad among the plurality of nozzles;

calculating an angle of ejection pattern of the steam based on an eject pressure of the steam ejected from the plurality of nozzles to determine a target separation distance based on the calculated angle of ejection pattern;

controlling the vertical driver, by the controller, to make the target separation distance smaller than a straight line distance, the straight line distance being a distance from an intersection point of a first virtual straight line extending along an inclined portion on one side of a first nozzle of the plurality of nozzles and a second virtual straight line extending along an inclined portion on one side of a second nozzle facing with the one side of the first nozzle to the ejector, wherein the second nozzle is disposed adjacent to the first nozzle, ejecting steam to the rotating polishing pad through the plurality of nozzles; and heating the plurality of nozzles so that the nozzles disposed to correspond to a peripheral region of the polishing pad among the plurality of nozzles, are heated to a higher temperature than the nozzles disposed to correspond to a central region of the polishing pad among the plurality of nozzles.

11. The method of claim 10, further comprising:

measuring a temperature of the polishing pad; and calculating a difference value between a central temperature which is a temperature of the central region, and a peripheral temperature which is a temperature of the peripheral region, wherein in the heating of the plurality of nozzles, when the difference value is greater than a predetermined set value, the nozzles disposed to correspond to the peripheral region of the polishing pad are heated to a higher temperature than the nozzles disposed to correspond to the central region, and wherein the peripheral region is disposed outside the central region in a radial direction of the polishing pad to surround the central region.

12. The method of claim 11, wherein the peripheral region includes an inner peripheral region surrounding the central region, and an outer peripheral region disposed outside the inner peripheral region in the radial direction to surround the inner peripheral region, wherein the measuring of the temperature of the polishing pad includes:

measuring the central temperature;

measuring a first peripheral temperature which is a temperature of the inner peripheral region; and measuring a second peripheral temperature which is a temperature of the outer peripheral region, wherein the calculating of the difference value includes:

calculating a first difference value that is a difference value between the central temperature and the first peripheral temperature; and calculating a second difference value that is a difference value between the central temperature and the second peripheral temperature, and wherein in the heating of the plurality of nozzles includes, when the first difference value is smaller than the set value and the second difference value is greater than the set value, the nozzles disposed to correspond to the outer peripheral area among the plurality of nozzles are heated to a higher temperature than the nozzles adjacent to the inner peripheral region among the plurality of nozzles.

13. The method of claim 11, further comprising determining a heating time corresponding to the difference value when the difference value is greater than the set value, wherein the heating of the plurality of nozzles is performed during the determined heating time.

* * * * *